US005080350A

United States Patent [19]

Schofield et al.

[11] Patent Number: 5,080,350

[45] Date of Patent: Jan. 14, 1992

[54] REHABILITATION AND/OR EXERCISE MACHINE

[76] Inventors: James M. Schofield, 2447 E. 72nd St., Tacoma, Wash. 98404; Henry H. Guillot, 23807 Entwhistle Rd., Buckley, Wash. 98321

[21] Appl. No.: 639,376

[22] Filed: Jan. 11, 1991

Related U.S. Application Data

[63] Continuation of Ser. No. 362,371, May 30, 1989, abandoned.

[51] Int. Cl.[5] ..... A63B 21/00; A63B 21/012

[52] U.S. Cl. ..... 272/131; 272/132

[58] Field of Search ..... 272/116, 131, 125, 129, 272/132, 133, 134, DIG. 4

[56] References Cited

U.S. PATENT DOCUMENTS

| | | | |
|---|---|---|---|
| 205,907 | 7/1878 | Ripka et al. | 248/457 |
| 397,352 | 2/1889 | Gaertner | 272/132 |
| 2,530,921 | 11/1950 | Tougas | 272/132 |
| 2,634,542 | 4/1953 | Bode | 248/457 |
| 2,921,791 | 1/1960 | Berne | 272/132 |
| 3,216,722 | 11/1965 | Odom | 272/132 X |
| 3,497,882 | 3/1970 | Weeks | 272/93 |
| 4,436,303 | 3/1984 | McKillip et al. | 272/132 |
| 4,471,957 | 9/1984 | Eugalitcheff, Jr. | 272/132 |
| 4,592,545 | 6/1986 | Sagedahl et al. | 272/125 |

FOREIGN PATENT DOCUMENTS 2057276 4/1981 United Kingdom ..... 272/131

OTHER PUBLICATIONS

"Isolated Joint Testing & Exercise", Cybex II Manual, 1981, pp. 1,2,33,35,37,39,51,52,56.

*Primary Examiner*—Richard J. Apley
*Assistant Examiner*—Jerome Donnelly
*Attorney, Agent, or Firm*—Delbert J. Barnard

[57] ABSTRACT

An apparatus usable in physical rehabilitation, exercising and conditioning of normal or injured arms, shoulders and upper body. The user grasps a handle (64) or a knob (66) and rotates an arm (52) against an adjustable, preset level of resistance over a field or range which is expandable to 360-degrees. The handle (64) is affixed to a rotation apparatus (52, 42, 24, 12, 10) which is universally adjustable in elevation, tilt-angles, swivel-motion, handle-extension and tension which can be applied simultaneously with 360-degrees of rotation. The apparatus makes possible the simulating and duplicating of a range of motion, congruent to the total, natural range of human motion of the arms, shoulders and upper body, so as to establish a more natural, effective and efficient means of exercise and rehabilitation.

13 Claims, 4 Drawing Sheets

REHABILITATION AND/OR EXERCISE MACHINE

This is a continuation of copending application Ser. No. 07/362,371 filed on May 30, 1989, now abandoned.

TECHNICAL FIELD

The present invention relates to physical rehabilitation and exercise machines. More particularly, it relates to the provision of a rehabilitation and exercise machine for the upper body, arms and shoulders, which provides for a rotational movement of the upper body part in an infinite number of planes, including a vertical plane, a horizontal plane, and all oblique planes between them.

BACKGROUND INFORMATION

Numerous exercise methods and devices have been created over the years for strengthening and rehabilitating normal and injured arms, shoulders and upper body. In general, the prior art devices involve the user's motion against some manner of resistance. A typical complaint about the known devices is that they are designed with a very limited capability for accommodating the normal or full range of motion of the human arms, shoulders and upper body. Therefore, they are not completely compatible or comfortable during use by the operator. Because most of these range-restricting devices are of sub-optimum design, only limited improvement in the level of strength and rehabilitation can be achieved.

By way of example, the motion required to manually saw a board appears to consist of a pushing and pulling, back-and-forth action. There are known exercise devices designed to accommodate such motion. However, they are somewhat limited to either vertical or horizontal movements. Another example of this kind of motion is found when lifting weights; as lifting weights primarily involves up-and-down or side-to-side movements.

In contrast, the movements of the arms, shoulders and upper body are for the most part rotational in nature rather than robotic-like up-and-down, and side-to-side movements. This is more fully realized and understood, as when a person is engaged in activities such as throwing a ball, swimming, bowling, swinging a baseball bat or tennis racket. It becomes apparent in such activities that many muscle groups are intricately involved while in rotational movement. The arms, shoulders and upper body are worked at various oblique angles and are constantly experiencing the varying degrees of torque that is applied at these oblique angles.

The primary object of the present invention is to improve upon the present state of physical rehabilitation and exercise machines, by providing a machine which simulates and duplicates a range of motion, congruent to the total, natural range of human motion of the arms, shoulders and upper body, so as to establish a more natural, effective and efficient means of exercise and rehabilitation. Additional objects of the present invention include:

to provide a new and useful rehabilitation and exercise machine;

to provide a novel and useful rehabilitation and exercise machine utilizing a variable three hundred and sixty degrees (360°) rotation element incorporated simultaneously with varying degrees of elevation, tilt-angles, swivel-motion, handle-extension and tension;

to provide a new and useful rehabilitation and exercise machine which exercises the different rotational motions of the upper body for identification and diagnosis of painful motion of injured arms, shoulders and upper body, as well as atrophied muscles and joints;

to provide a new and useful rehabilitation and exercise machine which simulates and duplicates the various oblique angles that occur during the rotational motions of the arms, shoulders and upper body, to provide a more natural, human range of motion to become more effective and efficient in rehabilitation;

to provide a new and useful rehabilitation and exercise machine which provides an opposing resistance for all the different rotational motions of the arms, shoulders and upper body for strengthening or conditioning;

to provide a new and useful rehabilitation and exercise machine which offers a fuller range of motion for obtaining greater flexibility of the arms, shoulders and upper body;

to provide a new and useful rehabilitation and exercise machine which simulates and duplicates the different motions of the body for repetitive training and conditioning of untrained and uncoordinated arms, shoulders and upper body movement; and to provide a new and useful rehabilitation and exercise machine which includes a method of measurement settings for elevation and swivel, tilt-angle adjustments, handle extension and applied tension, and rotation cycles.

DISCLOSURE OF THE INVENTION

The machine of the present invention is basically characterized by a vertical support post having a vertical centerline, a lower end which in use is fixed in position, and an upper end. A clevis is mounted on the upper end of the post, for rotational movement about a horizontal first axis which extends transversely of the support post. An arm is mounted on the clevis for rotation about a second axis which is perpendicular to the first axis. The arm extends radially outwardly from the second axis to an outer end. A control member is provided on the outer end of the arm. The control member is graspable by the hand of a user. The arm is rotatable about the second axis within a plane of rotation. A means is provided which adjustably affixes the clevis on the support post, to position the plane of rotation horizontally, vertically or at an oblique position between horizontal and vertical. The second axis coincides with the centerline of the post when the plane of rotation is horizontal. In use, the clevis is positioned to provide a desired plane of rotation. A user then grasps the control member and rotates his upper body to move said arm along an arcuate path within the selected plane of rotation.

According to an aspect of the invention, the machine may comprise a flat base and the lower end of the support post may be secured to the flat base.

According to another aspect of the invention, an adjustable brake means is provided between the clevis and the arm. The brake means provides an adjustable resistance to rotation of the arm relative to the clevis. In preferred form, a brake drum is secured to the arm, an adjustable brake band is carried by the clevis, and the brake band engages the brake drum.

The control member may be a handle which projects perpendicular from the arm and the handle may be mounted for rotation about a center axis, and relative to the arm. The control member may comprise a knob sized to be grasped by the user's hand and the knob may be rotatable about an axis extending perpendicular to the arm. In preferred form, both a knob and a handle are provided, with the knob endwise of the handle.

Also in preferred form, the clevis may comprise a pair of parallel cheek plates, one on each side of the upper end of the post, and a web interconnecting upper portions of the cheek plate. An axle extends from one cheek plate to another through an opening in the support post. The axle mounts the clevis onto the upper end of the post, for rotational movement about the horizontal first axis.

Other objects, advantages and features of the invention are hereinafter described as a part of the description of the best mode.

Best Mode For Carrying Out The Invention

Figure 1:
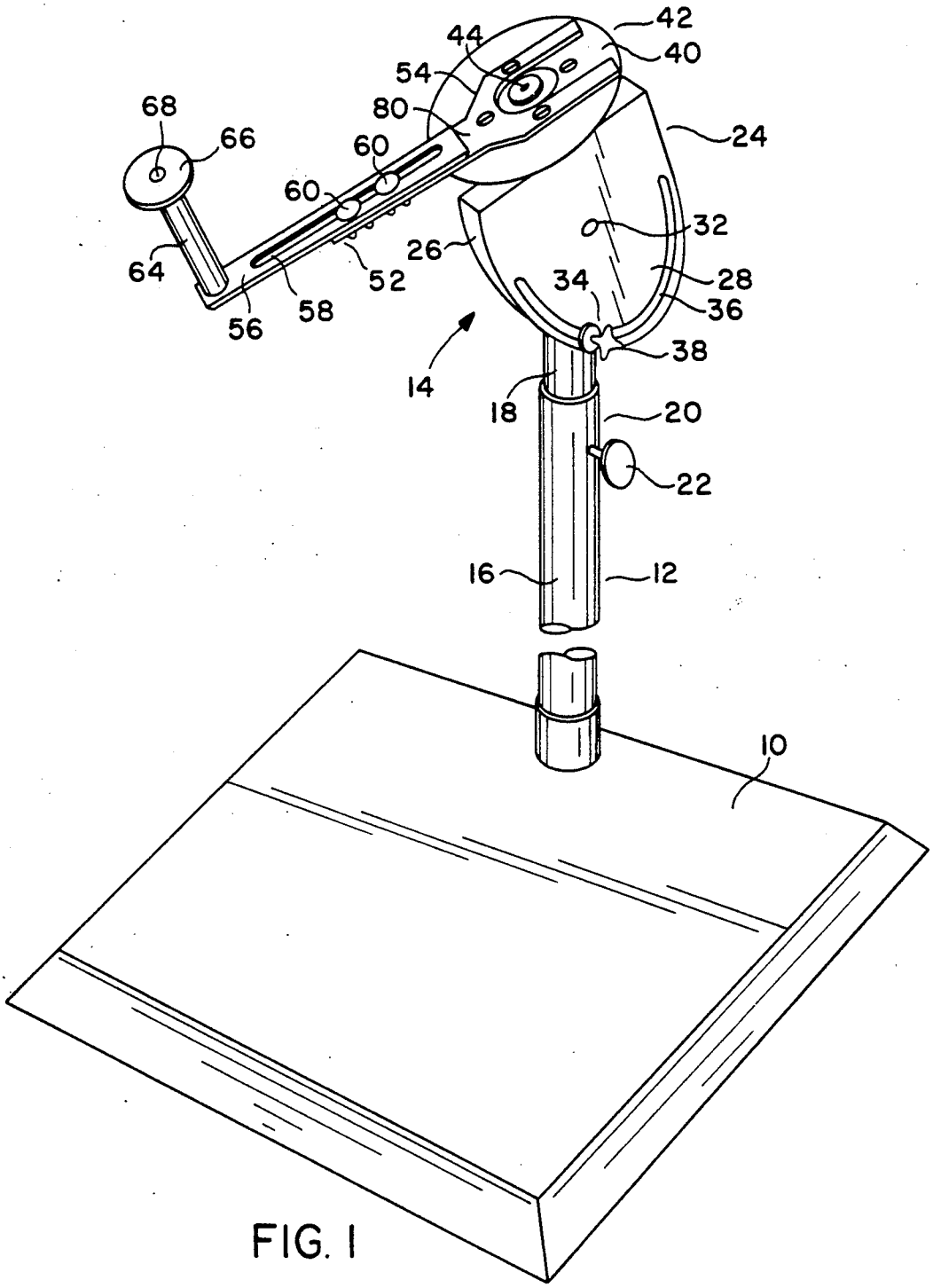
FIG. 1 is a pictorial view of an embodiment of the invention, taken from above and looking towards one corner of the base of the device, and showing the support post broken away intermediate its length, to indicate indeterminate length, for purposes of shortening the view.

FIG. 1 illustrates a preferred embodiment of the invention. It includes a rotation apparatus which is designed for use by an operator in a standing, sitting or prone position. The operator stands on, or is positioned on or above, a base structure 10. The base structure 10 supports a post 12 which in turn supports the rotation apparatus 14. The base structure 10 is preferably a stand-on platform. The post 12 comprises a lower tube 16 of a first diameter and an upper tube 18 of a smaller second diameter. The upper tube 18 is telescopically received within the lower tube 16. A set screw 20 is provided for affixing the upper tube 18 in position relative to the lower tube 16. The set screw 20 includes a control knob 22. By use of the set screw 20, the user can adjust both the height and the rotational position of the apparatus 14. The upper tube 16 is moved up or down, to establish the desired height of the rotation apparatus 14. The upper tube 16 is rotated in position relative to the lower tube 18 in order to establish the rotational position of the apparatus 14. When the apparatus 14 is located at a desired height, and in a desired rotational position, the knob 22 is grasped and rotated to tighten the set screw 20, to in that manner clamp the two tubes 16, 18 together and fix the apparatus 14 in such chosen position.

Figure 4:
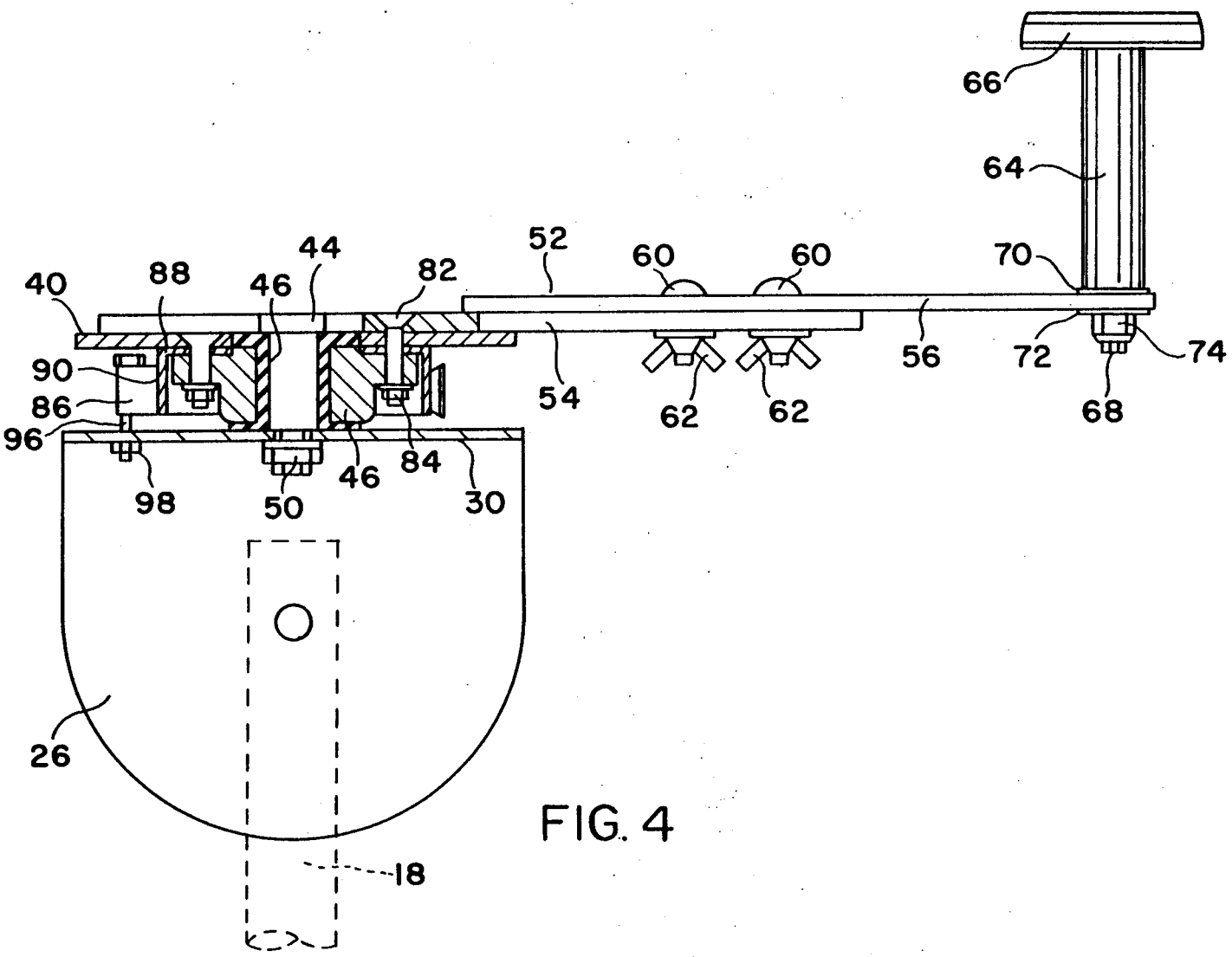
FIG. 4 is a vertical sectional view of the upper rotation apparatus, with some parts shown in side elevation.

As shown by FIGS. 1 and 4, a clevis 24 is mounted on and by the upper end of the support post 12. Clevis 24 comprises a pair of spaced apart cheek plates 26, 28 and an interconnecting web 30. A transverse pivot pin 32 mounts the clevis 24 for rotation within a vertical plane about the axis of pin 32. A set screw 34 extends through an arcuate slot 36 in cheek plate 28 and threads into threads in tube 16. Set screw 34 includes a control knob 38 which is grasped and used for rotating the set screw 34. This arrangement of the set screw 34, its control knob 38 and the arcuate slot 36 affords a means of adjusting tilt-angles describing a one hundred and eighty degree (180°) total arc.

Figure 3:
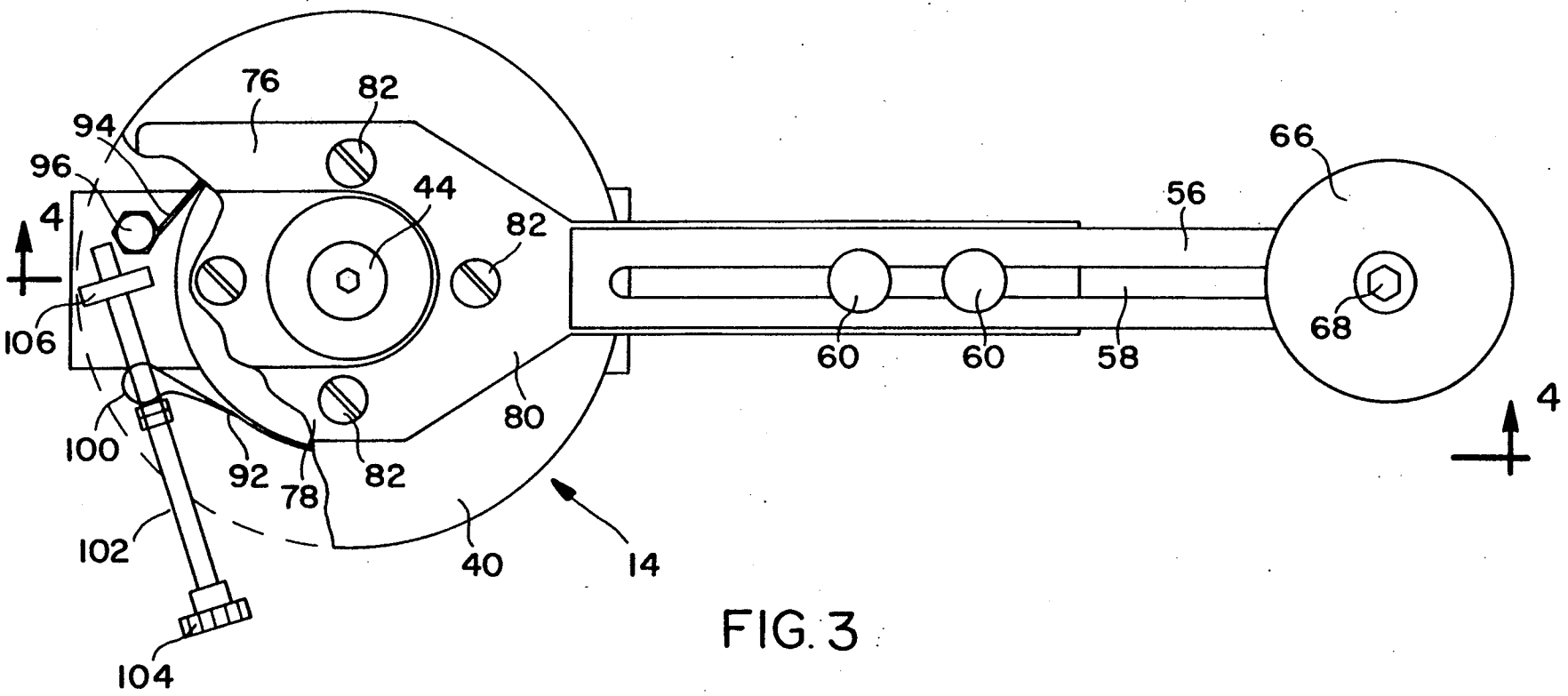
FIG. 3 is a top plan view of the upper rotation apparatus, with a foreground portion of a top plate cut away so as to expose the opposite ends of a friction brake structure.

The rotation apparatus 14, including the clevis 24 and the structure mounted on it, is the essence of the present invention. The structure atop clevis 24 includes a disk 40 which is the upper portion of a rotor 42 which revolves around an axle-bolt 44 (FIG. 4). Axle bolt 44 extends through a plastic bearing 46 and through an opening in the web 30. A washer 48 and a nut 50 below the web 30 secure the axle bolt 44, and hence the rotor assembly, to the web 30. An adjustable length arm 52 extends radially outwardly from the disk 40. Arm 52 includes an inner portion 54 and an outer portion 56. As best shown by FIG. 3, the outer arm portion 56 includes a slot 58 extending throughout nearly its total length. Retaining bolts 60 extend through the slot 58 and through openings in the inner arm portion 54 and at their lower ends make threaded engagement with wing nuts 62. The bolts and nuts 60, 62 secure the outer arm portion 56 to the inner arm portion 54, and also provide a way of adjusting the length of the arm 52. As will be appreciated, the wing nuts 62 are loosened on the retaining bolts 60, to permit the outer portion 56 to be extended or retracted relative to the inner arm portion 54, in order to adjust the arm 56 to the arm of the user. Then, the wing nuts 62 are tightened again for the purpose of securing the outer arm portion 56 in position relative to the inner arm portion 54 and establish the length of arm 52.

A handle 64 is mounted on the outer end of the outer arm portion 56. A knob 66 is positioned on the outer end of handle 64. A through bolt 68 extends through the knob 66, the handle 64 and the outer arm portion 56. The bolt 68 also extends through two washers 70, 72, one on each side of the outer arm portion 56. A retaining nut 74 is threaded onto the bolt 68 and serves to affix the handle 64 and the knob 66 to the arm 52, in a manner allowing both the handle 64 and the knob 66 to rotate freely about the axis of bolt 68.

The inner arm portion 54 has a substantially Y-shape in plan. Its inner end includes a pair of spaced apart tines 76, 78 and an interconnecting portion 80. As clearly shown by FIGS. 3 and 4, a plurality of bolts 82 extend through the inner end part of arm portion 54, through disk 40 and through portions of the rotor 52. Inner threaded ends of the bolts 82 thread into nuts 84 which are positioned below the rotor 42, between it and the web 30 (FIG. 4).

Figure 2:
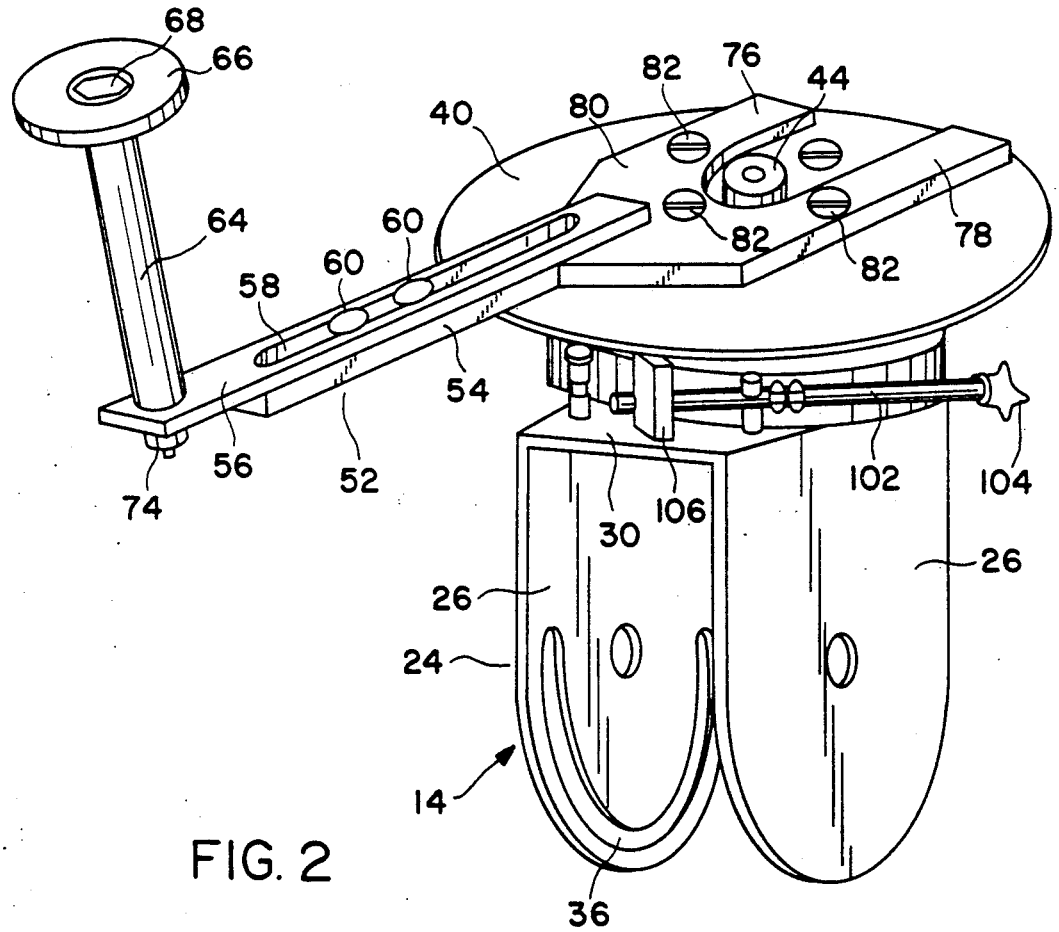
FIG. 2 is an enlarged scale pictorial view of the upper rotation apparatus, removed from the support post.

A brake drum 86 is positioned on the rotor 42. It has a radial wall portion 88 which is positioned between the rotor 42 and the disk 40. It also has a cylindrical portion 90 which surrounds the rotor 42. The bolts 82 extend through the radial wall 88 of the brake drum 86 and when the nuts 84 are tightened the bolts and nuts 82, 84 serve to secure the brake drum 86 to the rotor 42. As should be evident, the assembly of the rotor 42, the brake drum 86, the disk 40, and the arm 52, including handle 64 and knob 66, revolves around the axis of axle-bolt 44. When the web 30 is horizontal this axis coincides with the centerline of post 12. As shown by FIGS. 3 and 4, a brake band 92 surrounds the brake drum 86. One end 94 of the brake band 92 is secured or anchored to web 30 by an anchor bolt 96 and a nut 98 (FIG. 4). The opposite end 100 of the brake band 92 is secured to an adjustment bolt 102 which has a control knob 104 at its outer end. The opposite end of bolt 102 is threaded and screws into a threaded opening in an anchor member 106 that is affixed atop the web 30 (FIG. 2). As will be evident, rotation of the adjustment bolt 102 in one direction tightens the brake band 92 about the cylindrical portion 90 of the brake drum 86. Rotation of adjustment bolt 102 in the opposite direction loosens the brake band 92. The adjustment bolt 102 is operated by use of the knob 104. The operator rotates knob 104 in order to increase or decrease the level of desired resistance of rotation of the rotatable assembly 14 relative to the clevis 24. When the rotatable assembly 14 is in motion, the brake drum 86 rotates with the arm 52 against which frictional resistance is created by tightening the adjustment bolt 102. As the control knob 104 is turned, to cause the brake band 92 to approach or retreat from the anchor member 106, the brake band 92 correspondingly constricts or frees the rotating brake drum 86.

As previously stated, the clevis 24 is mounted for rotation through an arc of one hundred and eighty degrees (180°). This rotation moves the web 30 between a vertical orientation and a horizontal orientation. The arm assembly 52 rotates in a plane that is parallel to the plane of web 30. Accordingly, the above-described rotation of clevis 24 moves the plane of movement of the arm assembly between a vertical position and a horizontal position. As will be evident, the clevis 24 can be stopped in position at an infinite number of locations between a vertical position and horizontal position of web 30. Thus, the plane of rotation of the arm 52 is adjustable into an infinite number of positions between horizontal and vertical, in addition to in a vertical position and a horizontal position.

The handle 64 and the knob 66 are movable radially in and out relative to the axle-bolt 44, so as to adjust the apparatus to the particular arm length of a user. Extension and retraction of the adjustable support post 12, and rotation of the upper post portions 18 relative to the lower post portion 16 makes it possible to adjust the position of the arm assembly to the particular height of the user. The use of a small diameter support post 12 on a flat base structure 10 allows the user to be positioned closely adjacent the apparatus, particularly when it is adjusted to locate the arm assembly in a vertical plane.

Accordingly, the apparatus of the invention may comprise a stand-on platform base, an adjustable support post or stem, and supported rotation apparatus, usable for physical rehabilitation or exercise. The base of the apparatus may be formed in any manner, including the use of a stand-on platform base as is illustrated and described. The apparatus is portable but can be affixed to an immovable surface so as to secure it in its location. The use of the apparatus can adjust the elevation of the arm assembly by telescoping the supporting tubes and affixing the tubes into position by tightening the set screw. The arm assembly is usable to provide physical rehabilitation and exercise for the arms, shoulders and upper body in a natural, full range of motion, by simulating and duplicating all of the oblique angles to which torque can be applied.

In one aspect, the apparatus of this invention serves as a therapeutic aid for rehabilitating injured or atrophied muscles or joints. The operate the apparatus, the patient, standing or positioned on the base, would grasp either the handle or the knob atop the handle, and rotate the handle or knob around the axis of axle-bolt 44, up to three hundred and sixty degrees (360°). The machine is adjustable and can be varied by changing the elevation, tilt-angles, swivel, handle extension, and tension in any combination, together with the three hundred and sixty degree (360°) rotation capability. As the patient rotates the handle or knob against a pre-set level of resistance (the brake band), the injured or atrophied muscles or joints can be rehabilitated, strengthened, and trained.

In another aspect, the apparatus of this invention is universally adjustable to accommodate the full range of motion and to provide the maximum flexibility of the arms, shoulders and upper body of the user. In yet another aspect, the apparatus of the invention permits its use by patients who are ambulatory, confined to a wheel chair, or confined to a bed. In still another aspect, the apparatus of the invention serves as an exercise and conditioning means for training the human arms, shoulders, and upper body, to perform and repeat any of the several motions of the human body which can be achieved by this apparatus. To operate the apparatus, the user would engage the apparatus as previously stated. Continual repetition of rotation using low resistance causes the user to learn and coordinate rotational motion of the muscles and joints by rote repetition.

In another aspect, the apparatus of the invention serves as a novel strengthening device. To operate the apparatus, the user would engage the apparatus as previously described. Continual repetition of rotation using high resistance in any of the adjustable positions of the apparatus causes the user to develop muscle strength of those muscles involved. In yet another aspect, the apparatus of this invention serves as a novel diagnostic device. To operate the apparatus, the patient would engage the apparatus as previously described. Rotation of the handle or knob in any of the machines numerous adjustable positions can be an aid in locating, identifying and diagnosing the precise point of an injury.

In each aspect described, the apparatus of the invention provides the user or attendant the ability to monitor specific settings so that each of the adjustments: elevation, tilt-angle, swivel-action, handle-extension, tension and rotation, can be recorded.

The scope of protection is to be determined by the appended claims, interpreted in accordance with the established rules of patent claim interpretation, including use of the doctrine of equivalents.

We claim:

1. A machine operable by rotational movement of a user's arm to train or work an upper body part of the user, comprising:

a vertical support post having a lower end portion which in use is fixed in position, and an upper end portion that is coaxial with said lower end portion;

a clevis having a pair of cheek plates, between which the upper end portion of the support post is positioned, and a web interconnecting upper portions of the cheek plates;

an axle pivotally connecting the cheek plates of the clevis to the upper end portion of the support, for about 180° rotation of the web of the clevis about a horizontal first axis extending transversely through said upper end portion of the support post;

an arm mounted on the web of said clevis, for rotation about a second axis which is perpendicular to the first axis, said arm extending radially outwardly from said second axis to an outer end, said arm being rotatable about said second axis within a plane of rotation;

a hand engageable control member at the outer end of said arm adapted to be grasped by the hand of a user; and means for adjustably affixing the clevis on the support post, to position the plane of rotation horizontally, or vertically at a selected side of the support post, or at an oblique position between horizontal and vertical, on a selected side of the support post, said second axis extending substantially lengthwise of the post and intersecting said first axis when the plane of rotation is horizontal, whereby the clevis may be positioned to provide a desired plane of rotation and a user may grasp the control member and rotate his upper body to move said arm along an arcuate path within the selected plane of rotation.

2. A machine according to claim 1, further comprising a flat base, and where the lower end portion of the support post is secured to the flat base.

3. A machine according to claim 1, further comprising an adjustable brake means between the clevis and the arm, for providing adjustable resistance to rotation of the arm relative to the clevis.

4. A machine according to claim 1, wherein said control member comprises a handle projecting perpendicular from the arm, said handle having a center axis, and means mounting the handle for rotation relative to the arm about the center axis.

5. A machine according to claim 1, wherein the control member comprises a knob sized to be grasped by a user's hand, means mounting said knob for rotation relative to the arm about an axis extending perpendicular to the arm.

6. A machine according to claim 1, wherein the arm is adjustable in length to permit changes of the spacing of the control member from the second axis.

7. A machine according to claim 1, comprising an axle bolt connected to the web of the clevis, and projecting perpendicularly away from said web, and wherein said arm includes a rotor having an opening through which the axle bolt extends, said rotor in use rotating about said axle bolt.

8. A machine according to claim 7, comprising a radial bearing surrounding said axle bolt.

9. A machine operable by rotational movement of a user's arm to train or work an upper body part of the user, comprising:

a vertical support post having a lower end which in use is fixed in position, and an upper end;

a clevis mounted on the upper end of the support post for rotational movement about a horizontal first axis extending transversely of said support post;

an arm mounted on said clevis for rotation with a second axis which is perpendicular to the first axis, said arm extending radially outwardly from said second axis to an outer end;

a control member on said outer end which is graspable by the hand of a user;

said arm being rotatable about said second axis within a plane of rotation;

means for adjustably affixing the clevis on the support post, to position the plane of rotation horizontally, vertically or at an oblique position between horizontal and vertical, said second axis extending substantially lengthwise of the post when the plane of rotation is horizontal;

an adjustable brake means between the clevis and the arm, for providing adjustable resistance to rotation of the arm relative to the clevis, said brake means comprising a brake drum secured to the arm, and an adjustable brake band carried by the clevis, said brake band engaging the brake drum;

wherein the clevis may be positioned to provide a desired plane of rotation and a user may grasp the control member and rotate his upper body to move said arm along an arcuate path within the selected plane of rotation.

10. A machine according to claim 9, wherein the clevis comprises a pair of parallel cheek plates, one on each side of the upper end of the post, and a web interconnecting upper portions of the cheek plates, and a axle extending from one cheek plate to the other through an opening in the support post, for mounting the clevis on the upper end of the support post, for said rotational movement about said horizontal first axis.

11. A machine according to claim 9, wherein said control member comprises a handle projecting perpendicular from the arm, said handle having a center axis, and means mounting the handle for rotation relative to the arm, about the center axis.

12. A machine according to claim 9, wherein the control member comprises a knob sized to be grasped by a user's hand, means mounting said knob for rotation relative to the arm, about an axis extending perpendicular to the arm.

13. A machine operable by rotational movement of a user's arm to train or work an upper body part of the user, comprising:

a vertical support post having a lower end portion which in use is fixed in position, and an upper end portion that is coaxial with said lower end portion;

a clevis having a pair of cheek plates, between which the upper end portion of the support post is positioned, and a web interconnecting upper portions of the cheek plates;

an axle pivotally connecting the cheek plates of the clevis to the upper end portion of the support, for rotation of the clevis about a horizontal first axis extending transversely through said upper end portion of the support post;

an arm mounted on the web of said clevis, for rotation about a second axis which is perpendicular to the first axis, said arm extending radially outwardly from said second axis to an outer end, said arm being rotatable about said second axis within a plane of rotation;

a hand engageable control member at the outer end of said arm adapted to be grasped by the hand of the user; and means for adjustably affixing the clevis on the support post, to position the plane of rotation horizontally, vertically or at an oblique position between horizontal and vertical, said means including an arcuate slot in one of said cheek plates, having a center of curvature coinciding with said first axis, and a clamp screw means including a shank positioned within said slot, a threaded end portion engaging a threaded opening in the upper end portion of said support post, and a handle connected to said shank, outboard of the cheek plate, adapted to apply a clamping pressure on the cheek plate when rotated to move said threaded end portion into said threaded opening, said threaded opening being positioned on said support post vertically downwardly from said first axis, and said second axis extending substantially lengthwise of the post and intersecting said first axis and said threaded end portion of the shank when the plane of rotation is horizontal, whereby the clevis may be positioned to provide a desired plane of rotation and a user may grasp the control member and rotate his upper body to move said arm along an arcuate path within the selected plane of rotation.

* * * * *

UNITED STATES PATENT AND TRADEMARK OFFICE

CERTIFICATE OF CORRECTION

PATENT NO. : 5,080,350

DATED : January 14, 1992

INVENTOR(S) : James M. Schofield and Henry L. Guillot

It is certified that error appears in the above-identified patent and that said Letters Patent is hereby corrected as shown below:

On the cover, [76] Inventors:, "Henry H. Guillot" should be -- Henry L. Guillot --.

Column 5, line 62, "The", first occurrence, should be -- To --.

Signed and Sealed this

Twenty-seventh Day of April, 1993

*Attest:*

MICHAEL K. KIRK

*Attesting Officer*

*Acting Commissioner of Patents and Trademarks*